United States Patent [19]

Polit

[11] 3,954,548

[45] May 4, 1976

[54] BINDING STRIP APPLICATOR

[75] Inventor: Neil A. Polit, Cary, Ill.

[73] Assignee: Xerox Corporation, Stamford, Conn.

[22] Filed: Feb. 22, 1973

[21] Appl. No.: 334,821

[52] U.S. Cl. ..... 156/477 B; 11/1 R; 156/583; 281/21 R

[51] Int. Cl.[2] ..... B42C 13/00

[58] Field of Search ..... 156/477 B, 216, 475, 156/583; 11/1 R; 281/21 R

[56] References Cited

UNITED STATES PATENTS

| | | | |
|---|---|---|---|
| 3,531,358 | 9/1970 | Rost et al. | 156/475 |
| 3,788,921 | 1/1974 | Polit et al. | 156/216 |

*Primary Examiner*—William A. Powell
*Assistant Examiner*—J. J. Gallagher

[57] ABSTRACT

Method and apparatus for binding a stack of sheets whereby a binding member including a substrate material having at least one strip of heat activated adhesive is employed to form the desired book-like assembly. The binding member includes a low tack adhesive material extending longitudinally along the central portion of the substrate material and a high tack material extending longitudinally adjacent the low tack material and on either side thereof on the substrate material. The stack of sheets is transported into engagement with the binding member, the member being thus deformed so the low tack adhesive material is in contact with one edge of the sheets of the stack and the high tack adhesive material is in contact with the outer sheets of the stack. Heat is applied to the adhesive to cause the high tack material and low tack material to adhere to the portions of the stack in contact therewith. Pressure is applied to the side portions of the deformed substrate material so the high tack material is firmly pressed into contact with the outer sheets of the stack. Pressure is also applied to the portion of the substrate material in contact with the one edge of the sheets. A bond is thus formed between the substrate material and the stack of sheets to provide a book-like assembly.

3 Claims, 14 Drawing Figures

BINDING STRIP APPLICATOR

BACKGROUND OF THE INVENTION

This invention relates generally to sheet binding, and more particularly to apparatus for binding a plurality of sheets together in a stack to form a book-like assembly. Still more particularly, this invention relates to apparatus employing an adhesive binding member to obtain the bound assembly in a typical business office.

It is often desirable to secure a plurality of sheets of a report, book, or the like together in a bound assembly. While numerous arrangements for binding or assembling sheets together are available, each with certain inherent advantages of its own, many of these known arrangements at the same time suffer certain disadvantages such as high cost, low production rate, or the need for relatively complex applicator machinery, or the inability to edit or otherwise effect changes in a bonded assembly once the bonding operation has been completed.

Perhaps the most common method for assembling pages together is stapling. A staple generally comprises a metallic U-shaped member which is generally formed from drawn wire. The staples are driven under pressure through a stack of sheets and then bent or clinched on the bottom side of the stack to form the permanent assembly. Various mechanical arrangements have heretofore been devised for forming staples into the characteristic U-shaped as well as specific arrangements for inserting and removing the wire staples from the stack. Although the stapling process is employed quite extensively, there are certain disadvantages which are encountered when the aforementioned assembling method is utilized.

For example, the total number of pages that may be stapled together is limited; moreover the resulting product may not have the desired permanency or integrity since the staple or staples may become unhinged, or with sustained use of the book or pamphlet, the pages may tear out or otherwise work loose. Furthermore, the wire staples often times have a tendency to buckle or bend during the process of being driven into the stack of sheets; additionally, sometimes the wire staples are improperly bent or clinched on the underside of the stack. When either of these occur, the improperly inserted staple must therefore be removed and the process repeated until a properly driven and clinched staple is obtained. This results in unnecessary mutilation of the sheets in the stack as well as the consumption of unnecessary operator time in the binding operation.

Where the number of pages are too great for stapling, stitching may be resorted to. However, stitching requires relatively complex and expensive machinery which is normally found only in a bookbinding facility, and not in the business typical office. Additionally the editing of a bonded assembly produced by stitching is quite impractical due to the mutilation of the sheets that is likely to occur. In this latter case, metal clip or clamp assemblies may be resorted to. However, these require some type of punching or drilling mechanism to provide holes in the paper for the clip prongs, and if not performed accurately insofar as the hole formation is concerned, may result in mutilation of the sheets.

It has been proposed to use a binding member comprising a substrate material having an adhesive strip contained thereon to obtain a book-like assembly.

However, the members heretofore available have suffered many shortcomings, which have limited their utility. For example, essentially all of the binding members heretofore commercially available have had a single thickness of adhesive of either a low tack material or a high tack material applied onto a substrate material. For instance, it has been the practice ot provide a uniformly thick low tack adhesive coating on a substrate material. If the adhesive coating is applied relatively thin, generally an insufficient amount of adhesive material is provided between the edges of the sheets to be bound. Within relatively short periods of time, individual sheets would work loose from the remaining sheets of the assembly.

Alternatively, if a relatively thick low tack adhesive coating is applied to the substrate material, very often the material flows beyond the limits defined by the substrate material, particularly when the substrate material and low tack adhesive are brought into contact with the outer sheets of the stack. Furthermore, it has proven necessary to permit a heating element used to melt the low tack adhesive and apply pressure thereto so as to unite the substrate material to the outer sheets of a stack to cool to ambient temperature prior to disengagement from the binding member. If this were not permitted, an unsatisfactory bond is obtained since the low tack adhesive must be permitted to solidify before a satisfactory bond is provided. Naturally, the cooling of the heating element prior to disengagement limits the production rate of binding assemblies.

If a high tack adhesive coating were applied to the substrate material, insufficient flow of the adhesive between the sheets would occur due to the high viscosity of the high tack adhesive. Thus, individual sheets would readily separate from the assembly.

A further limitation in the utility of the binding members heretofore available has resulted from the apparatus presently on the commercial market. Binding members employed in such machines must be cut to an appropriate size depending upon the thickness of the stack of sheets being bound. The separate cutting operation required for each binding strip, particularly when the thickness of the stack might vary only a relatively small amount from one stack to the next, has limited the production rate of bound assemblies. Additionally, the separate cutting station required has increased either the cost of the binding apparatus or the labor cost involved in obtaining the bound assembly.

A binding member that has been found to be particularly satisfactory in achieving the desired objectives is disclosed in copending application, Ser. No. 196,446, filed Nov. 1, 1971 in the name of Donald W. Watson and assigned to the assignee of this application. In order to obtain widespread utilization of the binding member disclosed in the aforecited copending application, a satisfactory apparatus wherein such binding member may be employed is required.

However, it should be understood, the method and apparatus disclosed hereinafter are not intended to be limited to use with the binding member disclosed in the aforecited copending application, but may be otherwise employed with binding members heretofore available.

SUMMARY OF THE INVENTION

Accordingly, it is an object of the present invention to provide an improved method of binding a quantity of sheets together in a stack.

It is another object of the present invention to provide an economical and effective method of securing a quantity of sheets together to form a bound book-like assembly.

It is still another object of the present invention to provide a novel method of binding a quantity of sheets together in a stack which exhibits excellent holding capabilities.

It is still a further object of the invention to provide a novel method of binding a quantity of sheets together that permits editing and rebinding of the assembly to be accomplished.

It is yet a further object of the present invention to provide a novel method of binding a quantity of sheets together that permits a single width binding member to be employed regardless of variations in the thickness of a stack of sheets from one stack to the next.

It is a further object of the present invention to provide an improved apparatus for use in a business office, library or the like for securing a quantity of sheets together to form a bound book-like assembly.

It is yet a further object of the present invention to provide a novel binding apparatus particularly suitable for obtaining a bound book-like assembly wherein the binding member disclosed in the aforecited copending patent application may be satisfactorily employed.

It is still another object of the present invention to provide a novel binding apparatus economically suitable for use in the typical business office, library or the like.

It is yet a further object of the present invention to provide a novel apparatus that permits a single width binding strip to be employed regardless of variations in the thickness of a stack of sheets from one stack to the next.

It is yet a further object of the present invention to provide a novel apparatus wherein the operator thereof requires only a minimal amount of expertise.

It is still a further object of the present invention to provide apparatus to avoid the flow of adhesives which are part of the binding member onto the outer surfaces of the outer sheets of a stack or out the ends of a bound assembly.

Another object of this invention is to provide apparatus for binding of pages together with a binding member which insures that tracking of adhesive from book to book or to operating parts of the apparatus is prevented.

These and other objects of the present invention are attained by initially supporting an adhesive binding member in contact with one edge of a stack of sheets to be bound. It should be understood, as used herein, the term binding member or binding strip may include any width member, including the use of the member as the outer sheets of the assembly being bound. The binding member preferably includes a quantity of heat activatable low tack adhesive which extends longitudinally along the central portion of a formable substrate material, and a quantity of heat activatable high tack adhesive, which extends longitudinally on the substrate and substantially adjacent to, and on either side of the low tack adhesive. Such an arrangement, it will be appreciated can be constructed by first applying a uniform thickness of high tack adhesive to the substrate with the subsequent application of the low tack adhesive along the central portion of the substrate.

The strip of material is heated along the central portion to cause at least a portion of the low tack material to adhere to the edge of the sheets. Additionally, pressure is applied between the stack and the substrate to produce a partial flow of the adhesive that has adhered to the formable material and the sheets of the stack. Such heating is accomplished by the provision of a heated platen which is contacted by the strip material in the area of the low tack adhesive. In order to prevent the low tack adhesive from flowing beyond the ends of the strip material, the heated platen is prevented from contacting the strip material adjacent the ends thereof. The substrate material additionally contacts the outermost sheets of the stack and is heated to cause at least a portion of the high tack adhesive to adhere to the outermost sheets. Pressure is applied between the stacks and the formable substrate material to immediately bond the high tack adhesive that has adhered to the formable material and the outer sheets of the stack.

The heating means provided to heat the high tack adhesive may be removed to a position whereby the heating means no longer has any effect on the high tack adhesive without causing any deleterious effect upon the bond.

Other objects of the invention and further features thereof shall become apparent to those skilled in the art in view of the following detailed disclosure and description of a preferred embodiment of the invention, particularly when read in conjunction with the accompanying drawings.

DESCRIPTION OF THE PREFERRED EMBODIMENT

Figure 1:
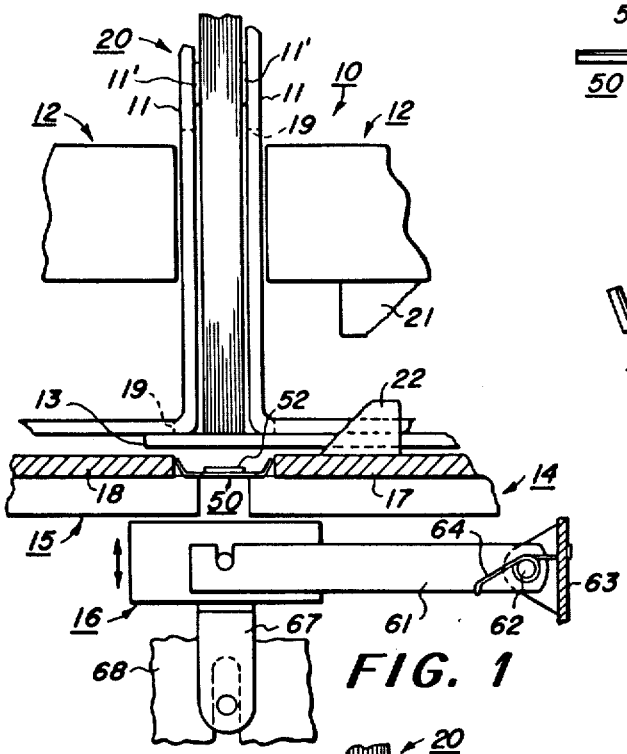
FIG. 1 is a sectional schematic representation of a binding apparatus in accordance with the present invention.

Referring now to the drawings and in particular to FIGS. 1 and 3–11 thereof, there are illustrated various steps in the method of binding as comtemplated by the present invention. In referring to the drawings, like numerals shall refer to like parts.

Figure 5:
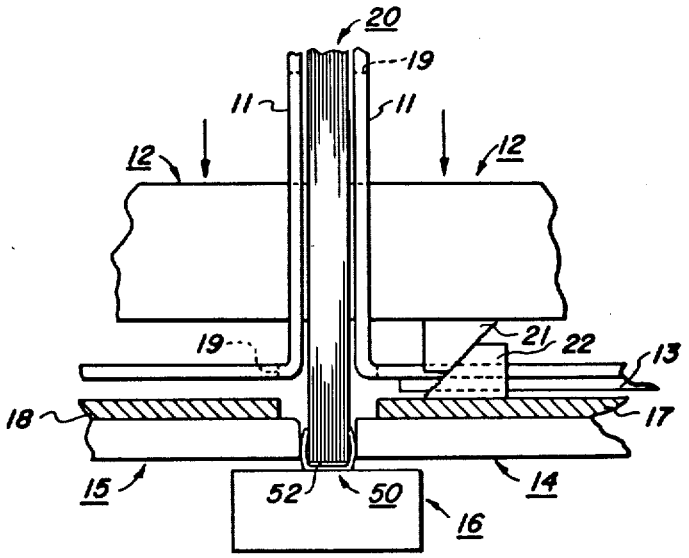

As illustrated therein one edge of a stack of sheets 20 to be bound is supported in contact with a strip of formable material 50 (see FIG. 5). The strip of material includes a quantity of heat activatable low tack adhesive 52 (FIGS. 2 and 2A) extending longitudinally along the central portion thereof, and a quantity of exposed heat activatable high tack adhesive 53 extending longitudinally thereof substantially adjacent to, and on either side of the low tack adhesive. As will be apparent from the aforementioned application, Ser. No. 196,446, the high tack adhesive 53 may be a suitable pressure sensitive material.

The strip of material 50 is heated along the central portion thereof (see FIGS. 5 and 6) to cause at least a portion of the low tack adhesive to adhere to the edge of sheets 20. In the preferred method in accordance with the present invention, binding member 50 is inserted into the machine, and the substrate material and thus the adhesive strips thereon are heated, prior to the stack of sheets being brought into contact therewith, (see FIG. 1). Thus, the adhesive on the substrate material is pre-heated. This has proven particularly beneficial in forming the bond between the low tack adhesive and the edges of the sheets. Additionally, pressure is applied between the stack and the formable material to produce a partial flow of the low tack adhesive that has adhered to the formable material and the sheets of the stack.

The formable material additionally contacts the outermost sheets of the stack (see FIGS. 5 and 6) and is heated to cause at least a portion of the high tack adhesive to adhere to the outermost sheets. Pressure is applied between the stack and formable material (see FIG. 6) to immediately bond the high tack adhesive that has adhered to the formable material and the outer sheets of the stack. In the instance where the adhesive 53 is pressure sensitive, pressure alone will effect the bond. Accordingly, deenergization of the means for heating the formable material adjacent the outer sheets of the stack may be required.

The low tack adhesive strip 52 is cooled to form a bond between the formable material and one edge of the sheets in the stack.

The foregoing method of binding a stack of sheets may be practiced by any suitable apparatus. One such apparatus that has proven highly satisfactory in accomplishing the foregoing method is schematically shown in FIGS. 1 nd 3–11 of the accompanying drawings.

Binding apparatus 10 includes a pair of sheet guides 11 which are spaced apart and provide opposed parallel surfaces. Book gauge 11' is suitable affixed to one end of guides 11. A plurality of individual sheets 20 may be inserted between the opposed surfaces of the gauge, the gauge, being then moved to firmly clasp the sheets. This sets guides 11 for the particular thickness of the sheets so the sheets may then be moved out of contact with gauge 11' and are then loosely maintained between the opposed surfaces of guides 11. Movable plate member 13 provides a surface upon which the lower edge of each of the sheets 20 may be supported. A pair of sheet engaging members 12 are movable in a direction generally perpendicular to the longitudinal axes of sheets 20. Members 11 can be provided with suitable openings 19 in the opposed surfaces thereof through which sheet engaging members 12 may be conveyed to firmly clamp the individual sheets therebetween to provide a relatively compact stack. Spaced apart from movable support member 13 is a first platen member 16. Opposed platen members 14 and 15 are spaced between first platen member 16 and plate member 13 and are adapted for movement in a path generally parallel to the path of movement of members 12.

Platen members 14, 15 and 16 may be operatively associated with suitable heating elements so each of the platen members may be heated to a desired temperature level for a reason that shall be more fully explained hereinafter. Although the heating elements are not shown, they may comprise suitable resistance elements connected through a switch to a source of electric power. Appropriate temperature regulating devices, for example, positive temperature coefficient resistance elements or negative temperature coefficient resistance elements may be operatively connected to the heating elements or integrally form a part thereof to obtain a desired predetermined temperature for each one of the platen members.

Strip guides 17 and 18 are preferably provided above platen members 14 and 15. Guides 17 and 18 properly position the binding member with respect to the various components of the apparatus. It should be noted, guides 17 and 18 are stationary, whereas, as noted before opposed platen members 14 and 15 are movable.

Figure 2:
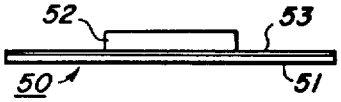
FIG. 2 is an end elevation view of a binding member that is particularly suitable for use with the present invention.
Figure 2A:
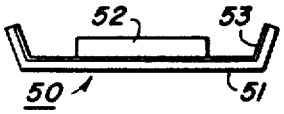
FIG. 2A is a modified form of the binding member illustrated in FIG. 2.

Referring now to FIGS. 2 and 2A there are disclosed end elevation views of a preferred binding member which may be employed in the apparatus and method of the present invention. Binding member 50 comprises a length or strip of formable backing or substrate material 51, normally comprised of relatively heavy paper stock bearing adhesive coatings. It should be understood that other substrate materials, for example fabrics, may be employed in lieu of paper. As illustrated, FIG. 2A depicts the binding member having preformed side flanges; it is this embodiment of the member which is shown in the remaining figures of the drawings.

The binding member substrate 51 carries a plurality of stripe-like formations comprising two heat activated adhesive types or a combination of heat activated and pressure sensitive adhesives. Heat activated adhesives may be either low or high tack types. A low tack adhesive comprises an adhesive material which when heated becomes fairly molten or fluid thereby providing a high degree of surface wet-out with minimum application of pressure or heat. A high tack adhesive comprises an adhesive material which when heated remains highly viscous and somewhat immobile so a definite amount of application of pressure and/or heat is necessary to wet-out the surface being adhered. High tack adhesives, in the heat activated case, have the advantage that on application of heat and pressure, the bond immediately possesses a high degree of strength.

Binding member 50 preferably includes a relatively thick elongated stripe 52 comprised of a low tack heat activated adhesive which is disposed on the substrate material 51 along the center line thereof. Typically, the width of the thick adhesive stripe 52 is approximately equal to or slightly greater than the overall thickness of the book being formed. Adhesive stripe 52 is suitably attached to the substrate material, for example, by heating the adhesive continuously therealong. The portions of the substrate material remaining on either side of adhesive stripe 52 as well as therebelow in the preferred embodiment of the strip are covered with a relatively thin coating of high tack heat activated adhesive 53, thus forming in cooperation with center stripe 52 three parallel stripes of adhesive. The thin stripes 53 of adhesive are substantially adjacent tht thick stripe thereof.

At noted, adhesive stripe 52 is relatively thick, a thickness of from 0.015 to 0.020 inches, for example, having been found to be suitable. The second adhesive 53 on substrate material 51 is relatively thin, a thickness of 0.001 to 0.005 inches, for example, having been found suitable.

With one adhesive formulation, the adhesive which comprises thick stripe 52, has an activation temperature in the range of 350°–450°F, while the adhesive which comprises thick stripes 53, has an activation temperature in the range of 250° to 350°F. It is understood that other suitable adhesive formulations may have different reactive temperature ranges. For a more detailed description of binding member 50, reference may be made to the aforecited copending patent application, filed in the name of Donald W. Watson.

Referring now to FIGS. 1 and 3–11, the manner in which the apparatus described herein operates to provide a bound assembly shall be explained.

FIG. 1 illustrates the apparatus with the sheets 20 held loosely between the opposed surfaces of guides 11. Binding member 50 may be inserted so it is supported by opposed platen members 14 and 15 and guided by strip guides 17 and 18. It should be understood that opposed platen members 14 and 15 may be initially positioned, either manually or automatically, in accordance with the thickness of, or the number of, sheets to be bound. Thus, for example, platen members 14 and 15 are spaced apart a relatively short distance when a relatively thin stack of sheets is to be bound; conversely, opposed platen members 14 and 15 are spaced apart a relatively large distance when a relatively thick stack of sheets is to be bound. It should also be understood, the heating elements associated with platen members 14, 15 and 16 may be energized so as to raise the temperature of the several platens to a predetermined level to thereby provide a pre-heat function. Thus, as shown in FIGS. 1 and 3, the relatively thin stripes 53 and relatively thick stripe 52 of binding member 50 are heated before the binding member is placed into contact with the sheets to be bound.

Sheet engaging members 12 are moved into engagement with sheets 20, which have previously been inserted between guides 11, to provide a substantially compact assembly. As noted before, suitable openings 19 are formed in guides 11 to accommodate the sheet engaging movement of members 12. As illustrated, sheet engaging members 12 are suitably affixed to links 24 and 25 through springs or similar devices. A cam 26 mounted about shaft 26', which is connected to a source of power not shown, is rotated in the direction of the arrow shown in FIG. 3. As the cam rotates in conjunction with the movement of the shaft, the lobe on cam 26 engages threaded member 27 and moves member 27 to the right. Member 27 is guided by guides 27' and 27'', and is threadably engaged with a barrel nut 65. End 65' of nut 65 extends through slot 32 so movement of member 27 is transmitted to link 24. Member 27 is threadably positioned relative to cam 26 in accordance with the thickness of sheets 20. A knob or dial 66 enables the operator to move link 24, via nut 65, relative to cam 26 by the rotation of member 27. Thus when the stack is relatively thick, link 24 is moved closer to cam 26, and when the stack is relatively thin, link 24 is moved away from the cam. For example, as link 24 pivots about point 28 so as to move its member 12 toward its sheet engaging position, link 29 simultaneously moves in a diagonal path downwards towards the left as viewed in FIG. 3. Link 25, which is attached to link 29, is thus pivoted about point 28' through link 31', so as to transport sheet engaging member 12, connected to link 25, into the illustrated position. Springs 30 attached to sheet engaging members 12 and frame member 55 are provided to return members 12 to their initial or disengaged positions once cam 26 rotates to a position wherein the lobe is no longer in contact with member 27. Other suitable means may be employed in lieu of springs 30 for returning members 12 to their initial position. Links 31 and 31' connected to links 24 and 25 at pivot points 28 and 28' respectively, also connect the link assembly to frame member 55.

Figure 3:
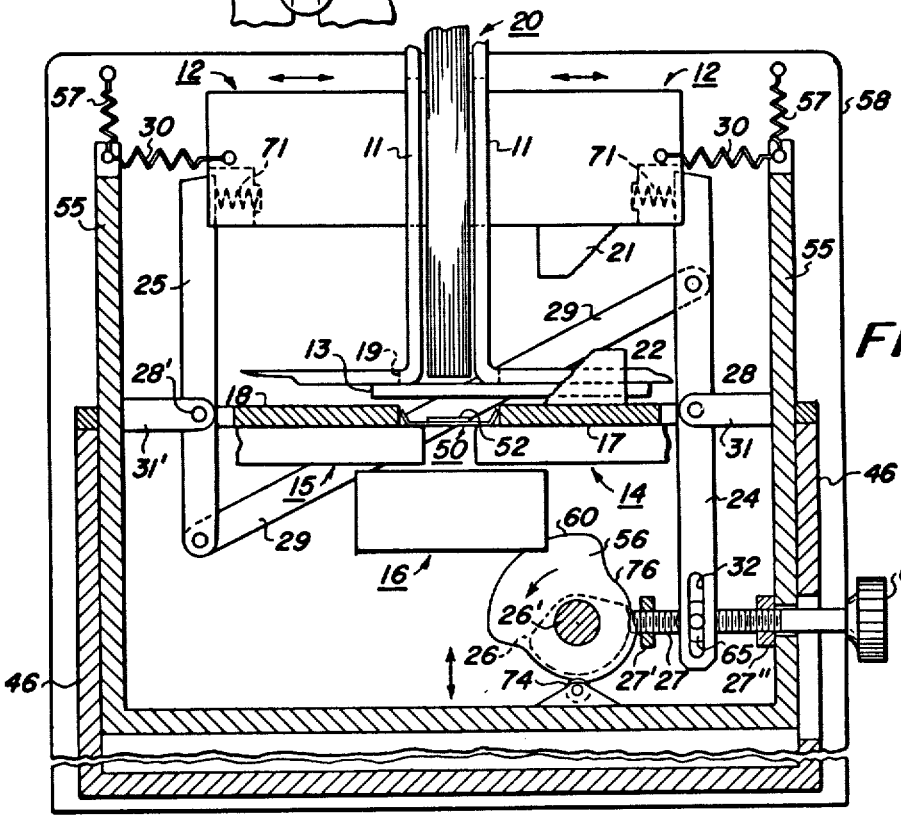
FIGS 3–11 show corresponding sectional schematics of a binding machine as contemplated by the present invention showing various phases of operation.

After sheets 20 have been engaged by members 12, cam 56 also mounted about shaft 26' is rotated to the position illustrated in FIG. 3, where the lowest surface thereof is in contact with cam follower 74 so as to permit springs 57, attached to frame member 55 and a stationary support member 58 to move the frame member and linkage assembly connected thereto, members 12 and thus sheets 20 upward so the sheets are spaced apart from plate member 13. This is illustrated in Fig. 3. It should be apparent that shaft 26', cams 26 and 56 and member 27 are maintained stationary with reference to the vertical movement of frame member 55. Slot 32 provided in link 24 accommodates the movement of the various members noted above.

Figure 4:
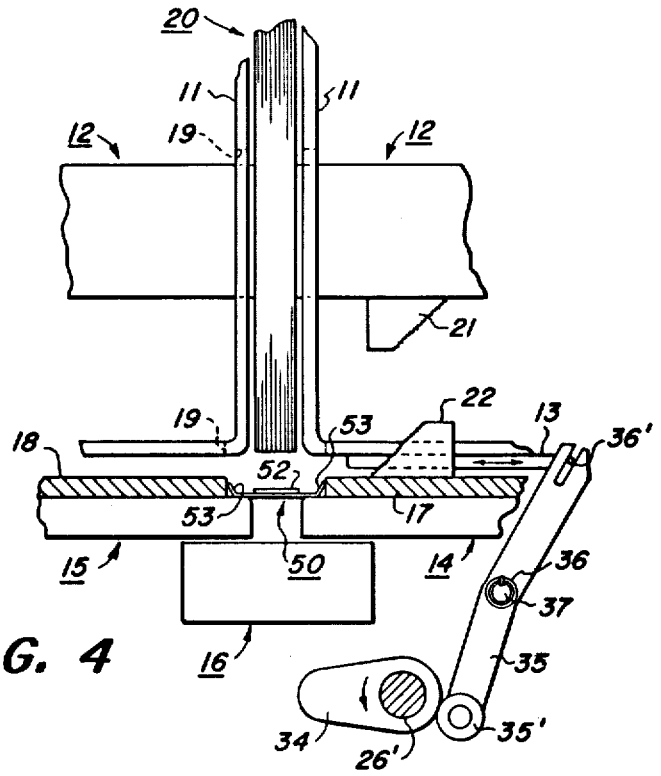

Referring now to FIG. 4, the next step in the operation of the apparatus of the present invention is illustrated. Subsequent to sheets 20 being raised above plate member 13, a third cam 34 mounted about shaft 26' is rotated in the direction of the arrow so the lowest surface of the cam contacts cam follower 35' which is suitably joined to link 35. The movement of the cam thus described causes link 35 to pivot about stationary shaft 37. Link 35 is connected to plate member 13 at point 36' in such a manner that the movement of link 35 through an arcuate path, causes member 13 to move through a linear path. A spring 36 is connected to shaft 37 and lever 35. When cam 34 is in a position such that the highest surface thereof is in contact with lever 35, member 13 is positioned as illustrated in FIGS. 1 and 3. Spring 36 is wrapped taut about shaft 37. When the cam rotates as shown in FIG. 4, spring 36 provides a force to move the lever and member 13 to the position illustrated in the figure.

Referring now to FIG. 5, it is observed that the stack of sheets engaged by members 12 is lowered into contact with binding member 50. Referring to FIG. 3, the manner in which the aforementioned action may be obtained is illustrated. Cam 56 rotating about shaft 26' moves so lobe 60 engages frame member 55, to thereby supply a force in opposition to the force supplied by springs 57, to move the frame member and attached linkage assembly downward. As noted before, slot 32 is provided in link 24 to accommodate this movement. Again referring to FIG. 5, it is observed that movement of sheets 20 into engagement with binding member 50 causes the binding member to be deformed into a generally channel-like or U-shaped configuration, and in addition thereto the central portion thereof, which is in contact with an edge of each of the sheets is firmly pressed into contact with first platen 16. As shown, stops 21 and 22 engage so as to limit the downward movement of the sheets. As noted before, the movement of members 12 into engagement with sheets 20 varies in accordance with the thickness of the stack. As indicated the varied movement is regulated by the relative position of threaded member 27 to cam 20 and the operation of springs 71. The relative position of stop 21 with reference to stop 22 will vary in accordance with the stack thickness; and similarly the engagement of stops 21 and 22 will also vary in accordance with stack thickness. Thus as the thickness of the stack is increased, the stops will engage at an earlier time during the downward travel of sheets 20 so as to decrease the movement of sheets 20 into contact with member 50.

Conversely, as the thickness of the stack is decreased, the stops will engage at a later time during the downward travel of sheets 20 so as to increase the movement of sheets 20 into contact with member 50. In order to accommodate different book thicknesses different width binding members are contemplated.

Figure 12:
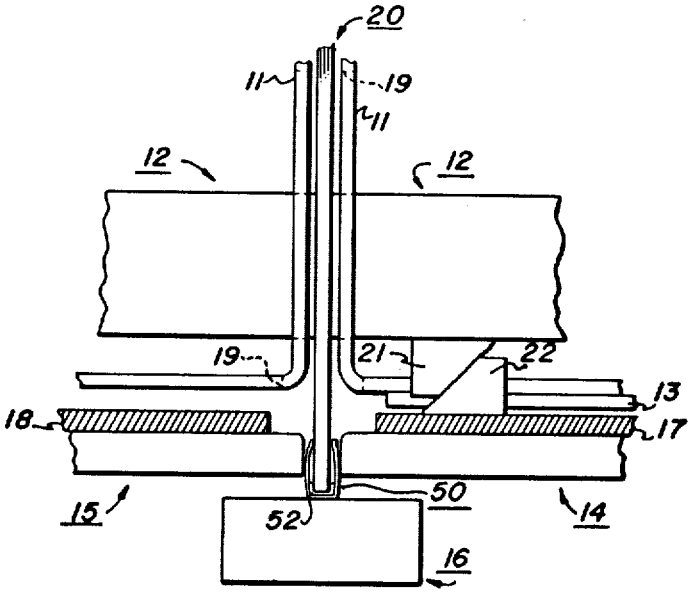
FIG. 12 is a sectional schematic representation illustrating the binding apparatus having a stack of sheets of a different thickness than the stack illustrated in FIG. 1.

Comparing FIG. 12 to FIG. 5, it is observed that the thickness of stack 20 is smaller in FIG. 12 than the stack illustrated in FIG. 5. However, the overall width of the binding member used in each example is identical in both figures.

It is observed in comparing the two figures that stops 21 and 22 are engaged along a greater surface when the thickness of the stack is decreased. This is desirable to maintain the position of low tack adhesive 52 below the surfaces of members 14 and 15.

As noted before, the movement of sheets 20 into contact with member 50 forces the center or planar portion of member 50 into contact with platen 16. Since the sheets have a varied movement in accordance with variations in the thickness of the stack, it is necessary for platen member 16 to be movable in a vertical direction to accommodate such varied sheet movement. As illustrated in FIG. 1, connected to platen member 16 is a link 61 which is pivotable about a shaft 62 and is connected to a fixed or stationary support 63. A spring 64 is provided to return link 61 and thus member 16 to their initial positions. Additionally, spring 64 supplies a force to push binding member 50 into intimate contact with the one edge of the sheets. The movement of the sheets and binding member 50 into contact with the platen member forces the member to move downward. Comparing FIG. 5 to FIG. 12, it is observed that member 16 moves a greater distance as the thickness of the stack is decreased. This is obviously necessary, in view of the increased distance a thin stack travels when compared to the distance a thick stack travels.

Again comparing FIGS. 5 and 12, it is also observable that, as a result of the increased travel occasioned by the decrease in stack thickness, the width of the planar portion of the binding member decreases and the height of the upstanding portions increase as the thickness of the stack is decreased. Furthermore, it is noted that the top surfaces of members 14 and 15 are in substantial alignment with the top surfaces of the upstanding portions of the deformed binding member regardless of variations in the length of movement of the sheets.

Again referring to FIG. 1, movable member 67 which is suitably affixed to stationary supports 68 maintains platen member 16 in a substantially horizontal plane, irrespective of its changed vertical position.

The center portion of binding member 50, having the thick low tack adhesive stripe 52 contained thereon, is heated by platen 16 so the adhesive adheres to the edge of the sheets. A heating period for the low tack material of from 12–15 seconds, for example, has been found to be suitable. As may be observed, the side portions of the substrate material 51 having the thin high tack adhesive stripes 53 contained thereon are forced upwardly so as to loosely engage the outermost sheets of the stack.

Figure 6:
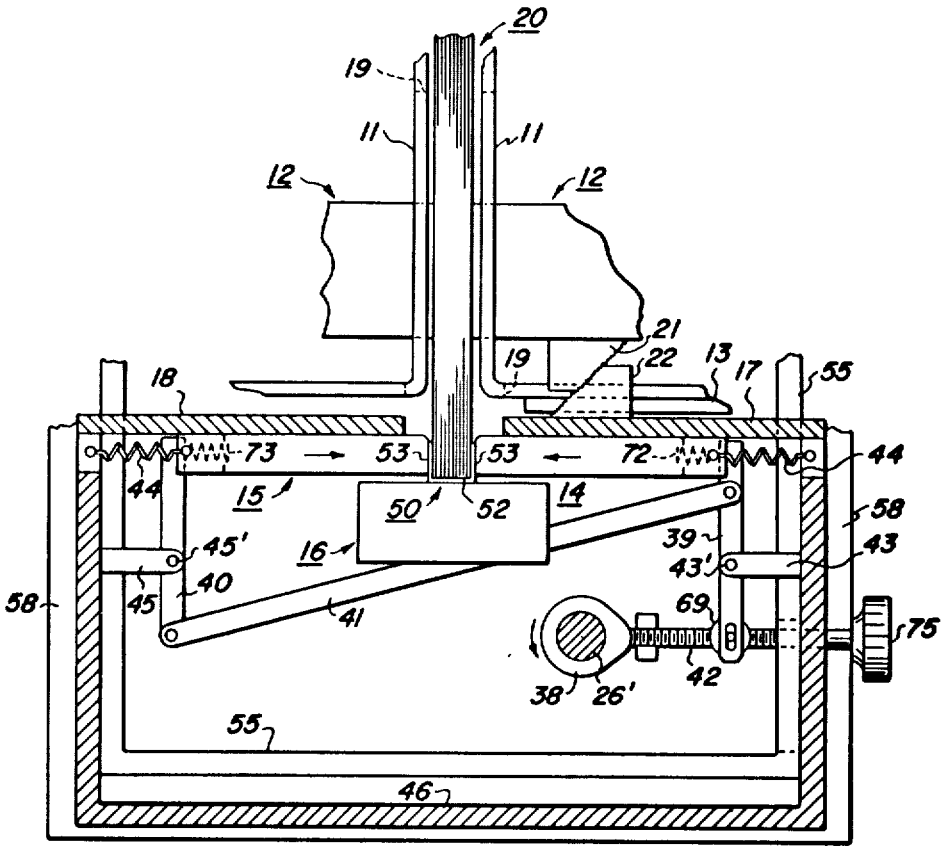

Referring now to FIG. 6, is is observed the opposed platen members 14 and 15 are moved inwardly so as to firmly press the relatively thin high tack adhesive stripes 53 into firm contact with the outermost sheets 20 of the stack. As previously noted, platen members 14 and 15 have heating elements associated therewith. Therefore, the high tack adhesive has a combination of heat and pressure applied thereto. A heating period for the high tack adhesive of from 8–12 seconds has been found to be suitable. It should be understood the two aforenoted heating periods may be concurrent if desirable.

The manner in which the movement of the opposed platen members into firm engagement with the side portions of binding member 50 is obtained shall now be explained. A fourth cam 38 is rotatably positioned about shaft 26'. Threaded member 42 is operatively connected to cam 38. Member 42 is threaded into engagement with barrel nut 69. The movement of cam 38 so the high point on the surface thereof engages member 42 causes the member to move toward the right as viewed in FIG. 6. Barrel nut 69 is suitably affixed to link 39; the movement of member 42 causes link 39 to pivot about point 43', through link 43 connected thereto. The position of member 42 with respect to cam 38 is varied in accordance with the thickness of the stack of sheets 20. A knob or dial 75 is adjusted by the operator to move link 39, via nut 69, relative to the cam, via rotation of member 42, such adjustment being coordinated in any suitable manner with adjustment of knob 66. Thus when the stack is relatively thick, link 39 is moved closer to the cam, and when the stack is relatively thick, link 39 is moved away from cam 38. Thus as link 42 is moved to the right, opposed platen member 14 is moved to the left (as viewed in FIG. 6) to firmly press one of the side portions of member 50 into engagement with its associated outermost sheet through the action of spring 73. A cross-link 41 is connected to link 39 so the movement thereof is transmitted to link 40. Thus, as link 39 pivots about point 43' so as to move member 14 in the manner described above, link 41 moves in a diagonal path downward towards the left, causing link 40 to pivot above point 45' through link 45 connected thereto, to cause platen member 15 to firmly press the side portion of binding member 50 into engagement with its associated outermost sheet through the action of spring 72. Springs 44 and links 43 and 45 are connected to a stationary frame member 46. Springs 44 provide the necessary force to return members 14 and 15 to their initial position as viewed in FIG. 1, when cam 38 rotates as the high point on the surface thereon no longer contacts member 42.

Figure 7:
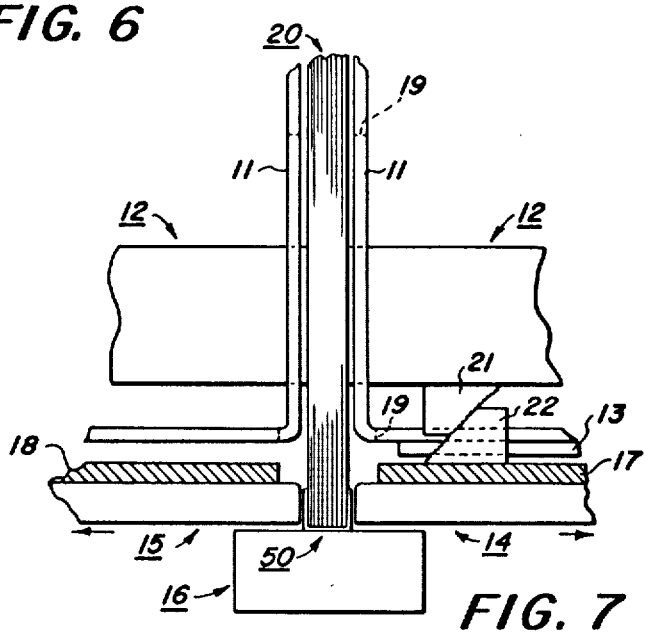

FIG. 7 illustrates the opposed platen members 14 and 15 after they have been withdrawn from contact with the side portions of binding member 50 by operation of cam 38, its associated linkage, and springs 44. As shown in FIG. 7, binding member 50 has been attached to the edge and outermost sheets of the stack.

Figure 8:
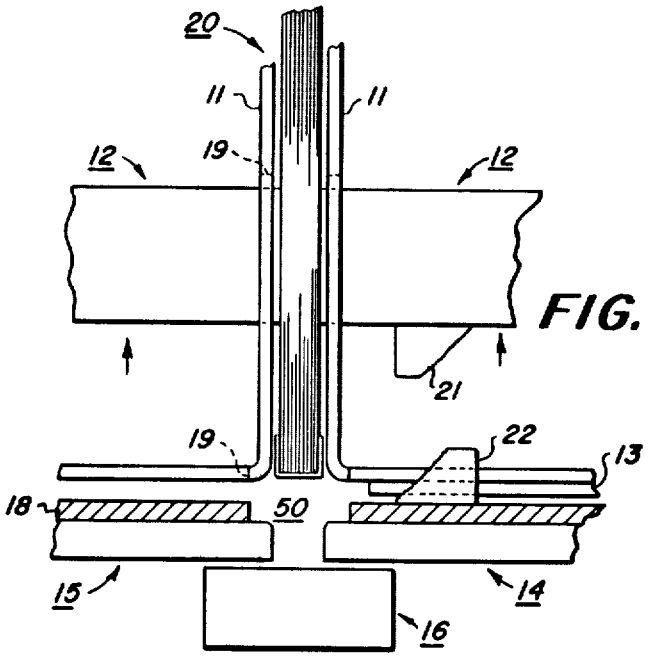

FIG. 8 discloses the manner in which the bonded stack is thence moved. The stack is raised upward so it is spaced apart from both the first platen 16 and the opposed platen members 14 and 15. The desired movement is obtained via the movement of cam 56 shown in FIG. 3, in conjunction with return springs 57. Cam 56 rotates so surface 76 thereof is in contact with cam follower 74 attached to frame member 55.

Figure 9:
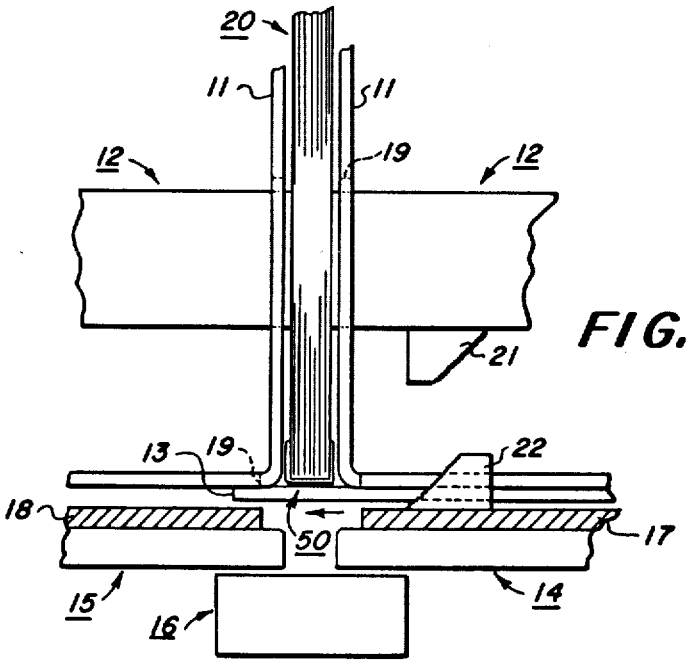

FIG. 9 shows the return of plate surface 13 to its initial position by the operation of the cam and associated linkage disclosed in FIG. 4. As noted hereinbefore, the rotation of cam 34 so the highest surface thereof contacts link 35 provides the restoring force to enable member 13 to return to its initial position.

Figure 10:
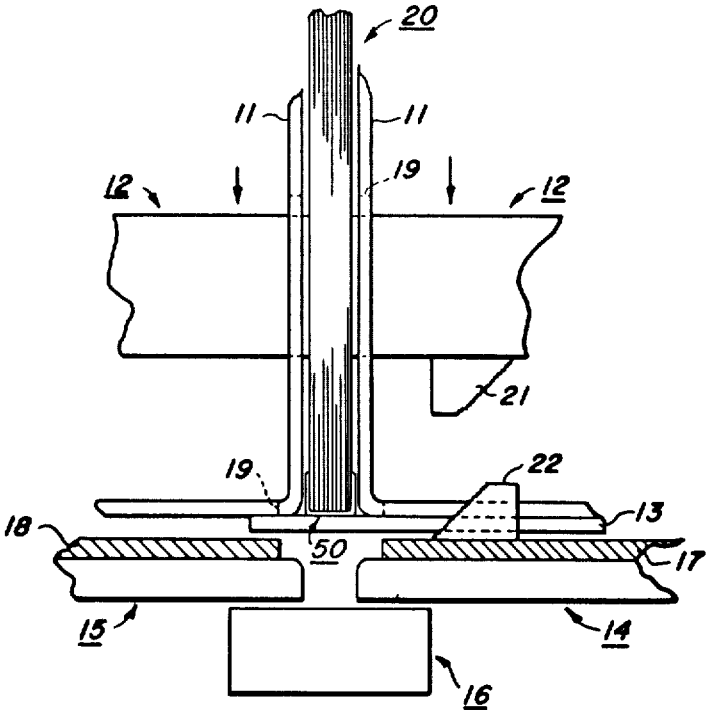

FIG. 10 illustrates the stack of sheets positioned so the bonded edge is supported upon member 13. The lowering of the stack is accomplished by operation of cam 56 and its associated mechanisms, shown in FIG. 3, whereby the surface of the cam in contact with member 55 is at an intermediate height.

Figure 11:
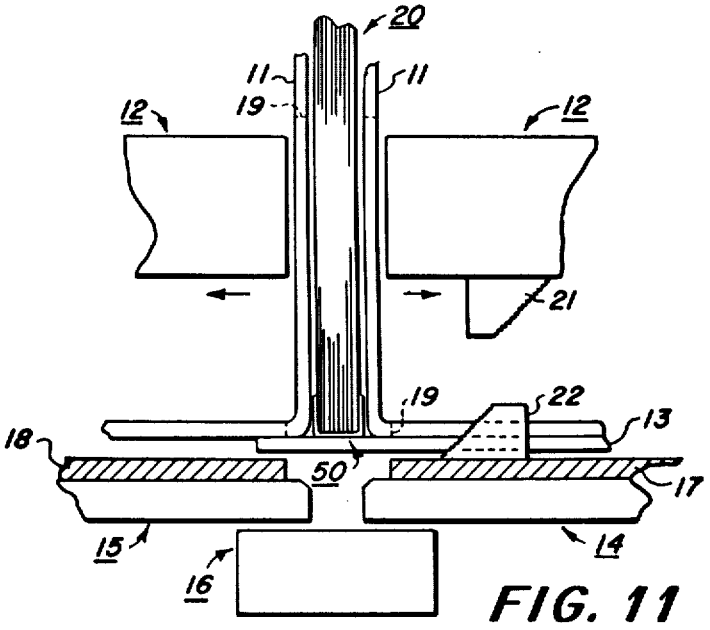

FIG. 11 illustrates sheet engaging members 12 in their retracted position wherein they have been disengaged from the bonded assembly. This is accomplished via the movement of cam 26 with reference to member 27. When the relatively low surface of the cam is rotated into contact with member 27, springs 30 cause links 24 and 25 to be pivoted in a reverse manner from the direction heretofore described. The book-like assembly is thence supported loosely between the opposed surfaces of guides 11 in the same manner as when the sheets were initially placed into the apparatus prior to their being bonded together.

The book-like assembly may thence be removed from the apparatus. A uniting of the sheets of the assembly is thus readily achieved in a relatively simple and economic manner. The apparatus and method disclosed herein provides bound book-like assemblies in a manner that overcomes the prior art defects described hereinbefore.

Figure 13:
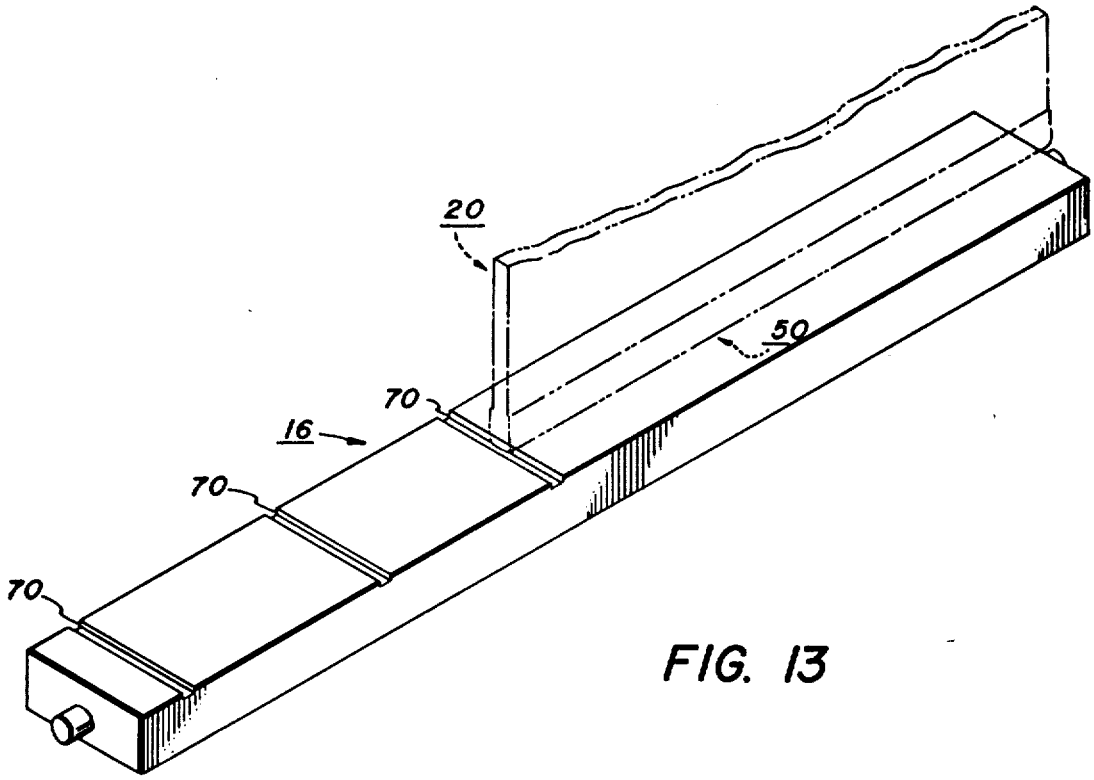
FIG. 13 illustrates a perspective view of a detail of the present invention.

FIG. 13 illustrates a perspective view of platen member 16. It has proven desirable to form the surface thereof which contacts the binding member and edges of the sheets with a plurality of grooves or channels 70. The grooves are formed in the surface of member 16 at predetermined distances, the distances being determined by the various length books it is desired for the apparatus to accommodate, with one exception which is the case when the ends of the pages or sheets and the binding member overhang both ends of the platen 16.

A stack of sheets is shown in phantom, positioned on the platen's surface. It is observed that one end of the stack overhangs an end of the surface. The other end of the stack is aligned with one of the channels 70. Channels 70 function to relieve the pressure provided by the platen member on the ends of the sheets and to also minimize transferred heat at the ends of the book or sheets so as to prevent any adhesive from being pressed outward beyond the limits of the substrate material and edge of the sheets. It will be appreciated that if the adhesive were allowed to be pressed beyond the ends of the substrate material, it would contaminate the platen 16 resulting in tracking of adhesive to successive books or possibly causing the apparatus to become temporarily inoperative.

One means of preventing tracking of adhesive from piece to piece would be to apply low tack adhesive to the binding strip in such a manner that portions of the strip adjacent the ends thereof are devoid of low tack material. When this is done, even if the adhesive flows towards the ends of the strip it will not travel beyond the ends thereof. Such an arrangement, however, poses problems in the manufacture of the strip.

Moreover, the employment of such strip material in an automatic strip feed machine would not be possible.

As noted before, one of the further features of the present invention relates to the further steps involving editing of a bonded assembly. After a bonded assembly has been obtained, it may be desirable to remove selected ones of the sheets, or add sheets to the assembly.

To accomplish the foregoing, the bound assembly is placed directly on heated platen 16 so the edge of the sheets and the substrate material connected thereto are heated. It should be understood that when an editing mode of operation is desired, platen members 14 and 15, guides 11 and members 12 are positioned so they permit the unrestrained movement of the assembly into contact with platen 16.

Support member 13 is removed from the path of travel of the assembly so it is in the position shown in FIG. 4.

Bonded stack 20 is maintained in contact with platen 16 for a predetermined period of time so that the low tack material is again rendered into a semi-liquid state. This permits the operator to effect the desired additions or deletions of selected ones of the sheets. The high tack adhesive maintains the book in its united form even though the low tack adhesive is heated.

The "new" stack is then reconveyed so it is spaced apart from platen 16. The low tack adhesive is thus permitted to resolidify to again provide a bound book-like assembly.

In the alternative, if it is desirable to remove only the outer sheets of the stack and the binding member, this may be accomplished after the low tack adhesive has been heated. The outer sheets may then be removed together with the binding member and the remaining sheets placed between new outer sheets and bound to a new binding member by repetition of the binding cycle.

It should be specifically noted that the various mechanisms disclosed herein may be replaced by equivalents without departing from the spirit of the present invention.

While the present invention is carried out in a specific embodiment, it is not intended to be limited thereby but it is intended to be covered broadly within the scope of the appended claims.

What is claimed is:

1. Apparatus for binding a stack of sheets into a book-like assembly, comprising:

means for effecting intimate contact between the pages of said book-like assembly and a binding member, said binding member comprising a substrate having any one of at least two predetermined lengths and at least a low tack adhesive carried thereby; and platen means, including a platen and a source of heat for the platen, for effecting a bonding of said pages and said binding member with the low tack adhesive, said platen being provided with at least one channel for preventing engagement of said platen with opposite and spaced apart short end sections of the binding member.

2. Apparatus according to claim 1 wherein said binding member has high tack adhesive carried thereby and further including means comprising a source of thermal energy for heating said high tack adhesive to a temperature different from the temperature to which said low tack adhesive is heated.

3. Apparatus according to claim 2 wherein said means for establishing intimate contact effects deformation of said binding member into a configuration having a substantially planar portion which is in contact with the edge surfaces of each of the sheets and two portions which are respectively in contact with the outermost sheets of the stack; and further including means for controlling the deformation of said binding member in accordance with the thickness of the stack.

* * * * *